United States Patent [19]

Jeschke et al.

[11] Patent Number: 4,603,641

[45] Date of Patent: Aug. 5, 1986

[54] DEVICE FOR REGISTER-MAINTAINING ALIGNMENT OF A FLEXIBLE PRINTING PLATE OF A PLATE CYLINDER OF ROTARY PRINTING MACHINE

[75] Inventors: Willi Jeschke, Heidelberg; Nikolaus Spiegel, Walldorf, both of Fed. Rep. of Germany

[73] Assignee: Heidelberger Druckmaschinen AG, Heidelberg, Fed. Rep. of Germany

[21] Appl. No.: 790,835

[22] Filed: Oct. 24, 1985

[30] Foreign Application Priority Data

Oct. 24, 1984 [DE] Fed. Rep. of Germany ..... 3438931

[51] Int. Cl.[4] ..... B41F 27/06; B41F 27/12; B41F 33/00

[52] U.S. Cl. ..... 101/415.1; 101/DIG. 12

[58] Field of Search ..... 101/415.1, 378, DIG. 12, 101/248, 409, 410, 411, 412, 413–415, 246; 33/184.5

[56] References Cited

U.S. PATENT DOCUMENTS

| | | | |
|---|---|---|---|
| 3,719,142 | 3/1973 | Abe | 101/415.1 |
| 3,858,512 | 1/1975 | Simeth | 101/415.1 |
| 3,882,775 | 5/1975 | Lytge et al. | 101/415.1 |

FOREIGN PATENT DOCUMENTS

| | | | |
|---|---|---|---|
| 3138865 | 4/1983 | Fed. Rep. of Germany | 101/415.1 |

*Primary Examiner*—J. Reed Fisher

*Attorney, Agent, or Firm*—Herbert L. Lerner; Laurence A. Greenberg

[57] ABSTRACT

A device for register-maintaining alignment of a flexible printing plate of a plate cylinder of a rotary printing machine, the plate cylinder being formed with a cylinder channel, tensioning rails being disposed in the channel and clamping rails for firmly clamping a respective end of the printing plate on the tensioning rails, the tensioning rails being adjustable in peripheral direction of the plate cylinder by tensioning screws includes a device for scanning the position of the printing plate in vicinity of a leading edge of the printing plate, and an electrical display device for indicating the scanned position of the printing plate, the scanning device including sensors respectively engageable in register holes formed in the printing plate in vicinity of the leading edge of the printing plate, when the printing plate is placed upon the plate cylinder, a holder carrying the sensors and extending parallel to the axis of the plate cylinder within the cylinder channel, the sensors being pivotable in peripheral direction of the plate cylinder so that a displacement of the printing plate in peripheral direction of the plate cylinder results in a corresponding deflection of the sensors in the peripheral direction, and a measuring device operatively associated with the sensors for generating signals corresponding to a displacement of the printing plate in the peripheral direction.

7 Claims, 3 Drawing Figures

DEVICE FOR REGISTER-MAINTAINING ALIGNMENT OF A FLEXIBLE PRINTING PLATE OF A PLATE CYLINDER OF ROTARY PRINTING MACHINE

The invention relates to a device for in-register or register-maintaining alignment of a flexible printing plate on the plate cylinder of a rotary printing machine and, more particularly, to such a device having tensioning rails disposed in the channel of the plate cylinder and clamping rails for firmly clamping a respective end of the printing plate on the tensioning rails, the tensioning rails being adjustable in the peripheral direction of the plate cylinder by means of tensioning screws, the position of the printing plate in vicinity of the leading edge of the printing plate being scanned, and being indicated by electrical indicating devices.

Two systems basically are provided for aligning a printing plate on a plate cylinder, and they differ in that register holes in vicinity of the leading edge of the plate, in the one system, and register stampings or punchings at the outer edge of the plate, in the other system, are used for aligning the plate. With regard to the first-mentioned system, German Patent No. 28 31 921 is known which describes optical means affording an extremely precise adjustment of the printing plate. This known embodiment does not, however, permit a determination by measurement technology of the respective diviation from a given so-called zero position.

Another heretofore known embodiment (German Patent No. 31 38 865) employs a scanner pin which is disposed with its end face at the leading edge of the printing plate, and displays the respective position of the printing-plate edge by means of an electrical display. A disadvantage of this construction is that a deformation occurs in the leading edge of the plate when it is firmly clamped, so that the measuring region on the plate can change. Also, varying clamping forces which act upon the leading region of the plate can cause a deformation of the measuring region. Because the contact point of the scanner pin, in the illustrated embodiment of the last-mentioned German patent, is not visible to the printer, even soiling or slight damage during transport of the printing plate can cause a faulty indication. With the last mentioned conventional system, a determination by measurement technology of the plate position may, in theory, indeed be possible, however, there are so many possible errors that may occur during practical application in the printing shop that reliable alignment of the flexible printing plate on the plate cylinder is not assured.

Taking this state of the art into consideration, it is accordingly an object of the invention to provide a device for register-maintaining or in-register alignment of a flexible printing plate which will ensure relatively easy operation and reliable handling without faulty measurements resulting from damage, deformation or soiling.

With the foregoing and other objects in view, there is provided, in accordance with the invention, a device for register-maintaining alignment of a flexible printing plate of a plate cylinder of a rotary printing machine, the plate cylinder being formed with a cylinder channel, tensioning rails being disposed in the channel and clamping rails for firmly clamping a respective end of the printing plate on the tensioning rails, the tensioning rails being adjustable in peripheral direction of the plate cylinder by tensioning screws, comprising means for scanning the position of the printing plate in vicinity of a leading edge of the printing plate, and electrical display means for indicating the scanned position of the printing plate, the scanning means including sensors respectively engageable in register holes formed in the printing plate in vicinity of the leading edge of the printing plate, when the printing plate is placed upon the plate cylinder, a holder carrying the sensors and extending parallel to the axis of the plate cylinder within the cylinder channel, the sensors being pivotable in peripheral direction of the plate cylinder so that a displacement of the printing plate in peripheral direction of the plate cylinder results in a corresponding deflection of the sensors in the peripheral direction, and a measuring device operatively associated with the sensors for generating signals corresponding to a displacement of the printing plate in the peripheral direction.

With these features, a sturdy construction adapted to printing practice is attained which ensures a high degree of measurement accuracy which is not impaired by mechanical influences. With the device according to the invention, it is possible to determine and display the parallel alignment of the register holes with respect to the cylinder axis within the range of microns, a relatively simple visual control of the measuring system being thereby enabled. The printer needs only to observe the display of the measurement signals, when aligning or orienting the plate on the plate cylinder, in order to effect alignment of the plate in a given position, such as the zero position, for example.

In accordance with another feature of the invention, the sensors are sensor pins and the measuring device includes a leaf spring via which the sensor pins are secured to the holder, the leaf spring being disposed parallel to the axis of the plate cylinder within the cylinder channel so that a displacement of the printing plate in peripheral direction of the plate cylinder results in torsion of the leaf spring, and expansion measuring strips secured to the leaf spring for generating signals corresponding to an extent of displacement of the printing plate in the peripheral direction.

In accordance with an additional feature of the invention, there are provided amplifier means connected to the expansion measuring strips for amplifying the signals, the electric display means being connected to the amplifier means for indicating the respective displacement of the printing plate in the peripheral direction in accordance with the signals.

In accordance with an added feature of the invention, at least two of the sensor pins are provided and are adjustable parallel to the axis of the plate cylinder when the leaf spring is unstressed.

In accordance with a further feature of the invention, the sensors are sensor pins formed with a ledge lightly engaging the underside of the printing plate, and wherein the sensor pins have a given diameter permitting a tipping movement of the sensor pins in the register holes.

In accordance with again another feature of the invention, the sensors are sensor pins, respectively, having the electrical display means in the form of an LED at an upper end thereof, the LED indicating by signal modulation a deviation of the printing plate from a given zero position.

In accordance with a concomitant feature of the invention, there are provided means for displaying actual positions of each side of the printing plate separately in the cylinder channel.

Other features which are considered as characteristic for the invention are set forth in the appended claims.

Although the invention is illustrated and described herein as embodied in a device for register-maintaining alignment of a flexible printing plate of a plate cylinder of a rotary printing machine, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
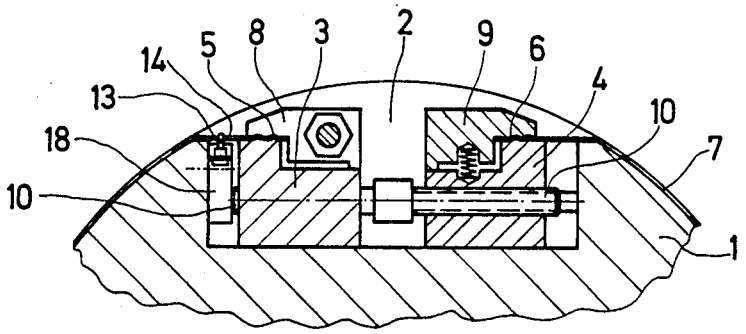
FIG. 1 is a fragmentary cross-sectional view of a plate cylinder with a printing plate clamped thereon by a clamping device.

Referring now to the drawing and first, particularly, to FIG. 1 thereof, there is shown a plate cylinder 1 formed with a cylinder channel 2 wherein tensioning rails 3 and 4 for both ends 5 and 6 of a flexible printing plate 7 are provided. Respective clamping rails 8 and 9 for the ends 5 and 6 of the printing plate 7 are assigned to both tensioning rails 3 and 4, the printing plate ends 5 and 6 for example, in corrugated form, being tightly clamped between the respective clamping rails 8 and 9 and tensioning rails 3 and 4. The tensioning rails 3 and 4 are capable of being shifted approximately tangentially by means of tensioning or clamping screws 10 and the printing plate 7 is thereby firmly clamped to the plate cylinder 1. With this conventional clamping device, it is possible to align the printing plate 7 in peripheral direction by means of tensioning or clamping screws 10 even when the printing plate 7 is in an inclined position.

Figure 2:
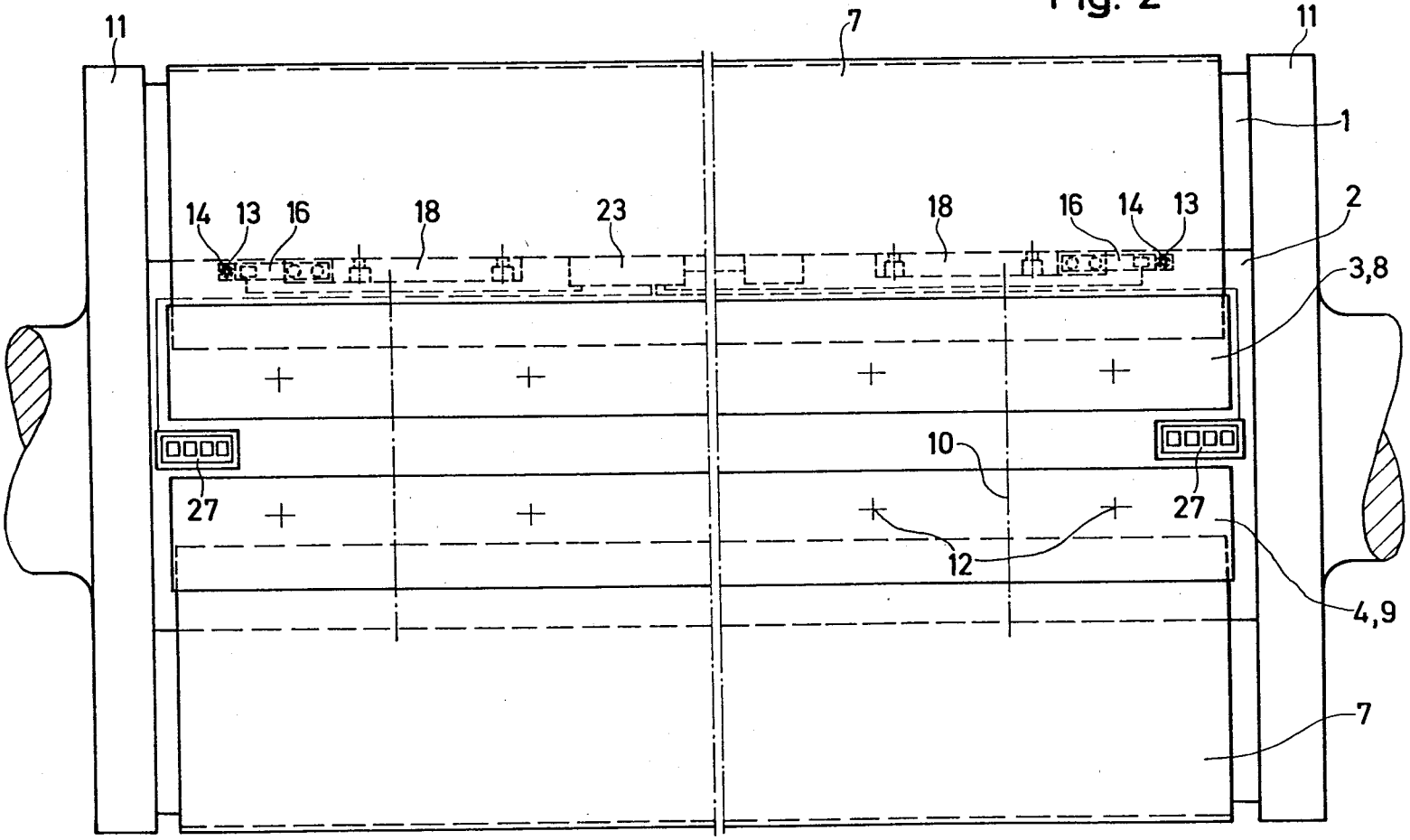
FIG. 2 is a diagrammatic plan view of FIG. 1 showing the plate cylinder with the device for in-register alignment constructed in accordance with the invention.

FIG. 2 is a top plan view of the plate cylinder 1 wherein Schmitz or bearing rings 11 are shown on both sides of the printing plate 7. A multiplicity of clamping screws 12 are also indicated by crossed lines on the clamping rails 8 and 9.

Figure 3:
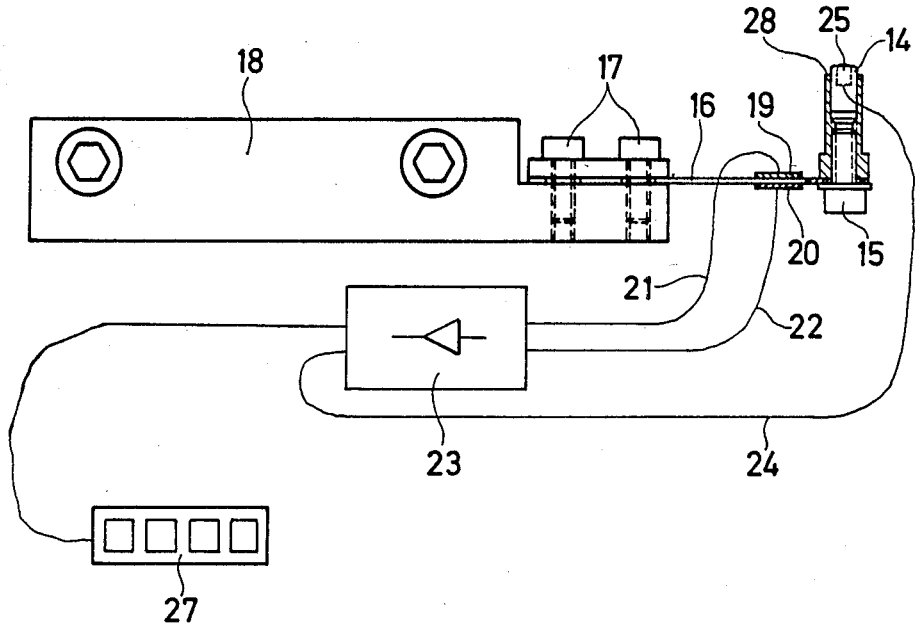
FIG. 3 is an enlarged elevational view of the in-register alignment device according to the invention.

In the vicinity of the leading or forward end 5 of the printing plate 7, register holes 13 are formed wherein sensor pins 14 engage when the printing plate 7 is placed upon the plate cylinder 1. Each sensor pin 14 is fastened by a screw 15 (FIG. 3) to a leaf spring 16. The latter is fastened in the cylinder channel 2 and parallel to the cylinder axis by means of screws 17 to a holder 18 which is threadedly secured to a side wall of the cylinder channel 2. The screws 17 thereby permit adjustment of the leaf spring 16 and, accordingly, of the sensor pin 14. Expansion measuring strips 19 and 20 are fastened to both sides of the leaf spring 16 and send a corresponding signal via lines 21 and 22 to an amplifier 23 upon the occurrence of a movement of the printing plate 7 in circumferential or peripheral direction and a twisting of the leaf spring 16 which is effected thereby. The thus amplified signal can be fed via a further line 24 to a light-emitting diode or LED 25 which is received in a recess formed in an end face of the sensor pin 14. This LED 25 can indicate the deviation of the printing plate 7 from a zero position by means of suitable signal modulation, for example, by flashing with increasing frequency.

The signals of the amplifier 23 are fed to a conventional display 27 through the aid of which it can be determined if the sensor pins 14 are in a zero position when the printing plate 7 is not inserted, the zero position being defined during assembly of the device. To detect an inclined positioning of the printing plate 7, two sensor pins 14 are provided which are disposed on both sides of the cylinder channel 2 in the outer region of the printing plate 7. Both sensor pins 14 are adjustable axially parallel to the cylinder 1, so that a means for observing or controlling the operation of the device in a relatively simple manner by operating personnel is provided. By a relatively simple movement of the sensor pins 14 by hand in peripheral direction of the plate cylinder 1, supervision of the operation of the device also can be effected by means of the display 25 or 27 when the printing plate is not inserted.

A ledge or collar 28 is provided on the sensor pin 14 which lightly engages the underside of the printing plate 7, so that the sensor pin 14 may readily slide out of the register hole 13, when a serious operating error has occurred. Also, the sensor pin 14 is formed with such a diameter that it can perform a tipping movement in the appertaining register hole 13. Adjustment of the sensor pins 14 is effected advantageously so that, in the zero setting of the printing plate 7, it always engages one side of the register holes 13.

The actual setting for each side of the plate can be indicated separately in the cylinder channel 2 on two displays 27. For the current supply of the measuring device, an auxiliary current source in the form of a battery (not illustrated in the drawings) can be provided in the cylinder channel 2.

In the aforedescribed device, a diagonal adjustment of the printing plate 7 can be effected in a relatively simple manner. In a possible failure of the system, the plate could be assembled so that the sensor pins 14 can dip into the register holes 13, without any movement in the peripheral direction, deviations of fractions of a millimeter being thereby possible, however. If the sensor pin 14 or the register hole 13 should become soiled somewhat during the practical manual handling thereof, the soil or dirt is scraped off when the sensor pin 14 is inserted into or withdrawn from the register hole 13, so that the sensor pins 14 and the register holes 13 are subject to automatic cleaning.

While employing the features of the invention, a ball can be used instead of the sensor pin or, to establish or demonstrate the peripheral shift, a contactless or capacitive measuring method, for example, can be used, which is suitable for actuating servomotors acting upon the tensioning rails, in precisely the same manner as described hereinbefore.

We claim:

1. Device for register-maintaining alignment of a flexible printing plate of a plate cylinder of a rotary printing machine, the plate cylinder being formed with a cylinder channel, tensioning rails being disposed in the channel and clamping rails for firmly clamping a respective end of the printing plate on the tensioning rails, the tensioning rails being adjustable in peripheral direction of the plate cylinder by tensioning screws, comprising means for scanning the position of the printing plate in vicinity of a leading edge of the printing plate, and electrical display means for indicating the scanned position of the printing plate, said scanning means including sensors respectively engageable in register holes formed in the printing plate in vicinity of the leading edge of the printing plate, when the printing plate is placed upon the plate cylinder, a holder carrying said sensors and extending parallel to the axis of the plate cylinder within the cylinder channel, said sensors being pivotable in peripheral direction of the plate cylinder so that a displacement of the printing plate in peripheral direction of the plate cylinder results in a corresponding deflection of said sensors in said peripheral direction, and a measuring device operatively associated with said sensors for generating signals corresponding to a displacement of the printing plate in said peripheral direction.

2. Device according to claim 1 wherein said sensors are sensor pins and said measuring device includes a leaf spring via which said sensor pins are secured to said holder, said leaf spring being disposed parallel to the axis of the plate cylinder within the cylinder channel so that a displacement of the printing plate in peripheral direction of the plate cylinder results in torsion of said leaf spring, and expansion measuring strips secured to said leaf spring for generating signals corresponding to an extent of displacement of the printing plate in said peripheral direction.

3. Device according to claim 2, including amplifier means connected to said expansion measuring strips for amplifying said signals, the electric display means being connected to said amplifier means for indicating the respective displacement of the printing plate in said peripheral direction in accordance with said signals.

4. Device according to claim 2 wherein at least two of said sensor pins are provided and are adjustable parallel to the axis of the plate cylinder when said leaf spring is unstressed.

5. Device according to claim 1 wherein said sensors are sensor pins formed with a ledge lightly engaging the underside of the printing plate, and wherein said sensor pins have a given diameter permitting a tipping movement of said sensor pins in said register holes.

6. Device according to claim 1, wherein said sensors are sensor pins, respectively, having said electrical display means in the form of an LED at an upper end thereof, said LED indicating by signal modulation a deviation of the printing plate from a given zero position.

7. Device according to claim 4, including means for displaying actual positions of each side of the printing plate separately in the cylinder channel.

* * * * *